US006408896B1

(12) United States Patent
Watanabe et al.

(10) Patent No.: US 6,408,896 B1
(45) Date of Patent: Jun. 25, 2002

(54) COOLANT CIRCULATING APPARATUS WITH AUTOMATICALLY RECOVERING MECHANISM

(75) Inventors: Mitsuhiro Watanabe; Masaki Noguchi; Yoshiaki Sueoka, all of Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/995,612

(22) Filed: Nov. 29, 2001

(30) Foreign Application Priority Data

Dec. 13, 2000 (JP) ..... 2000-379043

(51) Int. Cl.[7] ..... B65B 1/04

(52) U.S. Cl. ..... 141/59; 141/82; 141/95; 141/198; 222/146.6; 62/77

(58) Field of Search ..... 141/65, 59, 82, 141/83, 94, 95, 192, 198; 62/77, 142, 149; 184/1.5; 222/146.6

(56) References Cited

U.S. PATENT DOCUMENTS 4,993,461 A * 2/1991 Yamane ..... 141/231
5,335,705 A * 8/1994 Morishita et al. ..... 141/104
6,257,285 B1 * 7/2001 Robinson et al. ..... 141/121

* cited by examiner

*Primary Examiner*—Steven O. Douglas
(74) *Attorney, Agent, or Firm*—Oblon, Spivak, McClelland, Maier & Neustadt, P.C.

(57) ABSTRACT

In the coolant circulating apparatus for supplying a coolant in a tank to a heat load connected to the tank through a feed pipe and a return pipe in a circulating manner to cool the heat load, the coolant building up in the feed pipe, the heat load, and the return pipe is caused to flow back into the tank and recovered by supplying compressed gas from a compressed gas supply source into the feed pipe through a recovery gas duct when operation of the apparatus is completed and changes in a liquid level in the tank caused by supply and recovery of the coolant to and from the heat load are absorbed by, supplying or discharging compressed gas from and into a liquid level regulating gas duct into and from a liquid level regulating chamber to thereby push the coolant out from the liquid level regulating chamber or cause the coolant to flow into the liquid level regulating chamber.

4 Claims, 3 Drawing Sheets

(A)

(B)

(C)

COOLANT CIRCULATING APPARATUS WITH AUTOMATICALLY RECOVERING MECHANISM

TECHNICAL FIELD

The present invention relates to a coolant circulating apparatus for supplying coolant to a heat load in a circulating manner and more specifically to a coolant circulating apparatus with an automatically recovering mechanism in which the coolant filling the heat load and outside piping can be recovered automatically when operation is completed, in maintenance and inspection, and the like.

PRIOR ART

In this type of coolant circulating apparatus, in general, the coolant at an adjusted temperature is housed in a tank and supplied by a pump to the heat load in a circulating manner to thereby cool the heat load. The coolant the temperature of which rises due to cooling of the heat load and which flows back into the tank exchanges heat with a refrigerant in a heat exchanger to thereby adjust the temperature.

If such a coolant circulating apparatus is used for a treating process of a semiconductor, for example, very expensive completely fluorinated liquid is used as the coolant. Therefore, if an amount of coolant to be used is large, an initial cost becomes high. Therefore, it is desired to efficiently cool the heat load by using as small an amount of coolant as possible.

The heat load is normally connected to the circulating apparatus through outside piping prepared by a user. A kind, a heat capacity, a disposition place, and the like of the heat load are not necessarily the same at all times and are different in various manners depending on users. Therefore, a length, a diameter, and the like of outside piping are also different. The larger the length and the diameter of outside piping, the larger a volumetric capacity of the heat load including the outside piping becomes and the more a liquid level in the tank lowers when operation of the circulating apparatus starts to supply the coolant to the outside piping and the heat load. Therefore, if an amount of coolant housed in the tank is merely reduced, the liquid level in the tank may lower to hinder operation of the pump.

On the other hand, although it is preferable to recover all the coolant filling the heat load and outside piping into the tank when the operation of the coolant circulating apparatus is completed or at the time of maintenance, inspection, or the like, there has not been proposed means for easily, efficiently, and automatically recovering the coolant in the heat load and the outside piping. In recovering the coolant in this manner, the liquid level in the tank may rise and the coolant may overflow due to recovery of the coolant if the coolant of such an amount that a proper liquid level is obtained in an operating state has been housed in the tank. Therefore, it is necessary to prevent the liquid level from rising too much in recovery.

DISCLOSURE OF INVENTION

It is an object of the present invention to provide an economical and rational coolant circulating apparatus with an automatically recovering mechanism, the apparatus being able to be handled easily. In the apparatus, a heat load can be cooled efficiently by using a small amount of coolant, the coolant in the heat load and outside piping can be easily, efficiently, and automatically recovered and a liquid level in the tank does not change substantially in circulation of the coolant to the heat load and recovery of the coolant from the heat load.

To achieve the above object, a coolant circulating apparatus of the present invention comprises: a hermetically sealed tank in which a coolant at a controlled temperature is housed; a heat load connected to the tank through a feed pipe and a return pipe; a pump for supplying the coolant in the tank to the heat load through the feed pipe and the return pipe in a circulating manner; a liquid level regulating chamber communicating through a bottom portion thereof with an inside of the tank; a compressed gas supply source for supplying compressed gas; a liquid level regulating gas duct including a duct connecting the compressed gas supply source and the liquid level regulating chamber and a solenoid valve connected in the duct to regulate a liquid level of the coolant in the tank by causing the coolant to flow out into the tank from the liquid level regulating chamber or to flow into the liquid level regulating chamber from the tank by switching the solenoid valve to supply or discharge the compressed gas to and from the liquid level regulating chamber; a recovery gas duct including a duct connecting the compressed gas supply source and the feed pipe and a solenoid valve connected in the duct to cause the coolant building up in the feed pipe, the heat load, and the return pipe to flow back into the tank by switching the solenoid valve to supply the compressed gas to the feed pipe; a solenoid valve connected to a vapor phase portion of the tank to open the vapor phase portion to an outside in regulation of the liquid level of the coolant; a level switch provided in the tank to detect the liquid level of the coolant; a flowmeter connected to the return pipe to detect a flow rate of the coolant flowing in the return pipe; and a controller for controlling the pump and the respective solenoid valves.

It is preferable that the liquid level regulating chamber is disposed in the tank to occupy a part of a space in which the coolant is housed. It is preferable that a volumetric capacity of the liquid level regulating chamber is such a size that the coolant in the feed pipe, the heat load, and the return pipe can be housed in the liquid level regulating chamber.

In the circulating apparatus of the invention having the above structure, the liquid level of the coolant in the tank lowers when the coolant in the tank flows from the feed pipe into the heat load and the return pipe due to a start of operation of the apparatus and the liquid level of the coolant in the tank rises when the coolant filling the feed pipe, the heat load, and the return pipe is recovered into the tank after the operation is completed. Therefore, during the operation, the compressed gas from the compressed gas supply source is supplied into the liquid level regulating chamber through the liquid level regulating gas duct and the coolant in the liquid level regulating chamber is pushed out into the tank to thereby make up the reduction of coolant to maintain the liquid level at a height which does not hinder the operation of the pump. In recovery of the coolant, the compressed gas in the liquid level regulating chamber is discharged to cause a part of the coolant in the tank to flow into the liquid level regulating chamber to thereby absorb a rise of the liquid level in the tank. As a result, it is possible to efficiently cool the heat load while absorbing and regulating changes of the liquid level when the operation starts or in recovery by the liquid level regulating chamber by using a small amount of coolant.

The recovery of the coolant is carried out by supplying the compressed gas to the feed pipe through the recovery gas duct and pressing the coolant building up from the feed pipe in the heat load and the return pipe into the tank with the compressed gas.

By controlling by opening and closing the solenoid valves connected to the liquid level regulating gas duct and the recovery gas duct with the controller to automatically carry out the regulation of the liquid level and the recovery of the coolant synchronously, it is possible to easily, efficiently, and automatically recover the coolant in the heat load and the piping.

DETAILED DESCRIPTION

Figure 1:
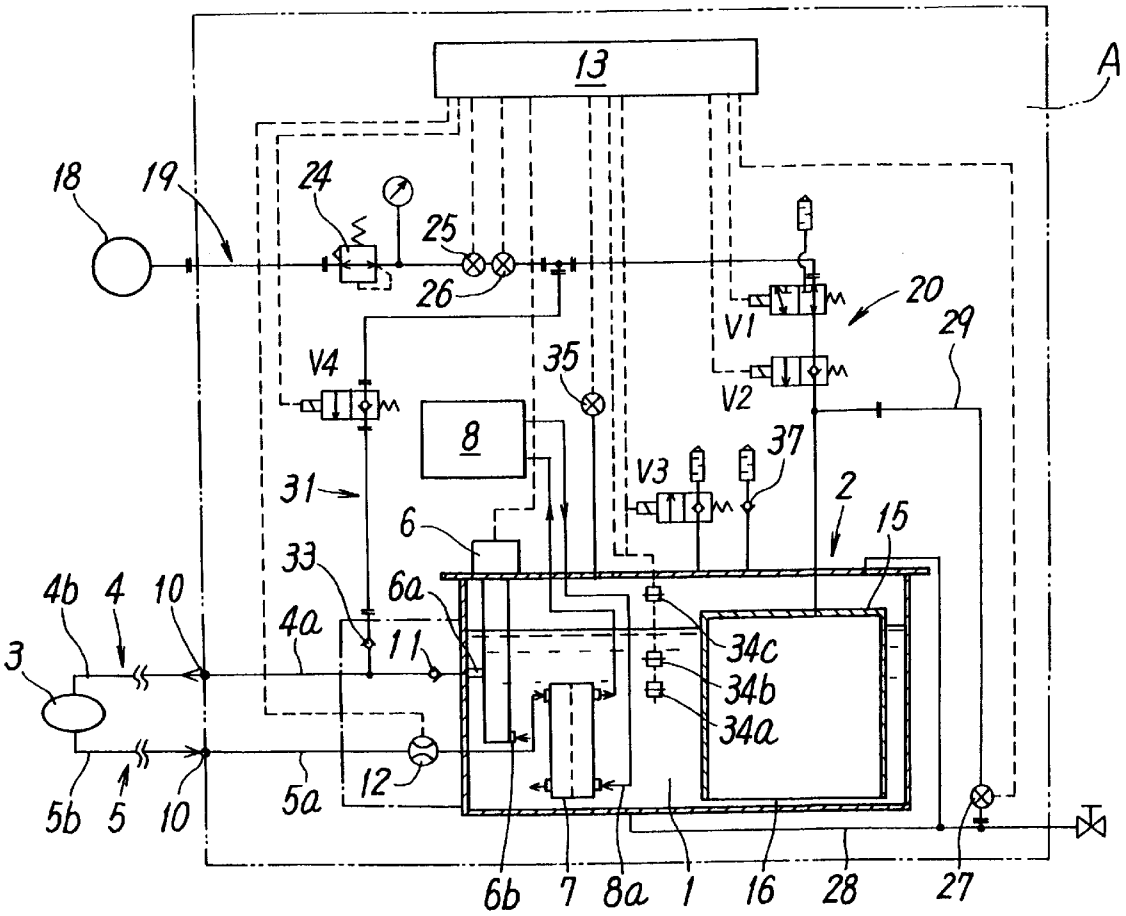
FIG. 1 shows a block diagram schematically showing an example of a coolant circulating apparatus according to the present invention.

FIG. 1 schematically shows a preferred embodiment of a coolant circulating apparatus according to the present invention. The coolant circulating apparatus A includes a hermetically sealed tank 2 in which coolant 1 controlled to be at a set temperature is housed. As the coolant 1, completely fluorinated liquid, pure water, ethylene glycol, or the like is used, for example.

A heat load 3 is connected to the tank 2 through a feed pipe 4 and a return pipe 5. A pump 6 is provided to the tank 2 with a discharge hole 6*a* of the pump 6 communicating with the feed pipe 4. By supplying the coolant 1 in the tank 2 by the pump 6 to the heat load 3 through the feed pipe 4 and the return pipe 5 in a circulating manner, the heat load 3 is cooled with the coolant 1.

The coolant 1 a temperature of which rises due to cooling of the heat load 3 and which flows back into the tank 2 is cooled by exchanging heat with a refrigerant in a heat exchanger 7 provided in the tank 2 and adjusted to be at a set temperature. The heat exchanger 7 is connected to a refrigerating circuit 8 and the refrigerant is supplied from the refrigerating circuit 8 through a duct 8*a* in a circulating manner. Because such a temperature adjusting system of the coolant 1 by using the refrigerating circuit 8 is already known, further description will be omitted here. When the temperature of the coolant 1 becomes too low due to cooling by the heat exchanger 7, the coolant 1 is heated and the temperature of the coolant 1 is increased by a heater provided in the tank 2. Because such heater means is also known art and is not directly related to the gist of the invention, the heater means is not shown in the drawings.

The feed pipe 4 and the return pipe 5 are respectively divided into an inner feed pipe 4*a* and an inner return pipe 5*a* positioned in the circulating apparatus and an outer feed pipe 4*b* and an outer return pipe 5*b* connected to connecting ports 10 at end portions of the inner feed pipe 4*a* and the inner return pipe 5*a* and extending outside the apparatus. The heat load 3 is connected to the outer feed pipe 4*b* and the outer return pipe 5*b*. A check valve 11 for preventing the coolant 1 flowing from the inner feed pipe 4*a* toward the tank 2 from flowing backward is connected to the inner feed pipe 4*a* and a flowmeter 12 for measuring a flow rate of the coolant 1 flowing back to the tank 2 is connected to the inner return pipe 5*a*.

In the tank 2, a liquid level regulating chamber 15 is disposed to occupy a part of a space in which the coolant is housed. The liquid level regulating chamber 15 has a connecting portion 16 formed of a gap, a hole, or the like at a bottom portion of the chamber 15, i.e., at a lower end portion or in a vicinity of the lower end portion and communicates with an inside of the tank 2 through the connecting portion 16. A volumetric capacity of the liquid level regulating chamber 15 is such a size that substantially the same amount or a slightly larger amount of coolant as or than the coolant 1 filling the heat load 3, the feed pipe 4, and the return pipe 5 can be housed in the chamber 15. A volumetric capacity of the tank 2 excluding the volumetric capacity of the liquid level regulating chamber 15 is such a size that a whole amount of the coolant 1 excluding the coolant in the heat load 3 and piping can be housed in the tank 2 while leaving a small margin.

The liquid level regulating chamber 15 is connected to a compressed gas supply source 18 provided outside the apparatus through a supply gas duct 19 and a liquid level regulating gas duct 20. The liquid level regulating gas duct 20 is for regulating a liquid level of the coolant 1 in the tank 2 by supplying or discharging high-pressure compressed gas to and from the liquid level regulating chamber 15 to cause the coolant 1 in the liquid level regulating chamber 15 to flow out into the tank 2 or to cause the coolant 1 in the tank 2 to flow into the liquid level regulating chamber 15 and has a three-port first solenoid valve V1 and a two-port second solenoid valve V2 connected in series in the duct 20. The second solenoid valve V2 is a solenoid valve having a check function of stopping only a flow in one direction and allowing a flow in a reverse direction when the valve V2 is in an off switching state. The solenoid valve V2 is connected in such a direction as to stop a flow of compressed gas flowing from the compressed gas supply source 18 toward the liquid level regulating chamber 15 in the off switching state.

A regulator 24 for maintaining gas pressure constant and sensors 25 and 26 for checking whether the circulating apparatus is connected to the compressed gas supply source 18 or not and whether the gas pressure is adjusted to necessary pressure by the regulator 24 are connected in the supply gas duct 19. A reference numeral 27 in the drawing designates a liquid level sensor for detecting presence or absence of the coolant 1 in the liquid level regulating chamber 15 and is connected in a duct 29 between the liquid level regulating gas duct 20 and a drain pipe 28 connected to a bottom portion of the tank 2.

On the other hand, between the feed pipe 4 and the compressed gas supply source 18, a recovery gas duct 31 for causing the coolant building up in the feed pipe 4, the heat load 3, and the return pipe 5 to flow back into the tank 2 by supplying compressed gas into the feed pipe 4 is connected. The recovery gas duct 31 is connected between a position downstream from a check valve 11 provided to the inner feed pipe 4*a* and a position downstream from the pressure sensors 25 and 26 provided to the supply gas pipe 19. In the duct 31, a two-port fourth solenoid valve V4 and a check valve 33 for preventing backflow of gas and coolant flowing from the feed pipe 4 side toward the supply gas duct 19 side are connected. The fourth solenoid valve V4 is a solenoid valve having a check function of stopping only a flow in one direction and allowing a flow in a reverse direction when the valve V4 is in an off switching state. The solenoid valve V4 is connected in such a direction as to stop a flow of compressed gas flowing from the compressed gas supply source 18 toward the feed pipe 4 in the off switching state.

In the tank 2, a plurality of level switches 34*a*, 34*b*, and 34*c* for detecting the liquid level of the coolant 1 are provided at different heights and a sensor 35 formed of a pressure switch for detecting internal pressure is connected.

A third solenoid valve V3 for opening a vapor phase portion of the tank 2 to an outside in liquid level regulation and recovery of the coolant 1 is connected to the vapor phase portion of the tank 2. A reference numeral 37 designates a check valve for safety for releasing the internal pressure of the tank 2 to the outside when the pressure exceeds certain pressure. The third solenoid valve V3 is a solenoid valve having a check function of stopping only a flow in one direction and allowing a flow in a reverse direction when the valve V3 is in an off switching state. The solenoid valve V3 is connected in such a direction as to stop a flow of exhaust flowing outside from the tank 2 in the off switching state.

The pump 6, the respective solenoid valves V1 to V4, the flowmeter 12, the pressure sensors 25, 26, and 35, the level switches 34*a* to 34*c*, and the liquid sensor 27 are respectively connected to a controller 13. By controlling by switching the respective solenoid valves by the controller 13, regulation of the liquid level of the coolant 1 in the tank 2 by the liquid level regulating gas duct 20 and recovery of the coolant 1 in the heat load 3, the feed pipe 4, and the return pipe 5 by the recovery gas duct 31 are carried out.

In the circulating apparatus having the above structure, during normal operation, the coolant 1 in the tank 2 circulates between the tank 2 and the heat load 3 in such a manner as to be drawn into a suction hole 6*b* of the pump 6 and supplied to the heat load 3 through the feed pipe 4 to thereby cool the heat load 3 and then to flow back into the tank 2 through the return pipe 5 as shown in FIG. 1. At this time, because high-pressure compressed gas is supplied into the liquid level regulating chamber 15 from the compressed gas supply source 18 through the liquid level regulating gas duct 20 and fills an inside of the liquid level regulating chamber 15, almost all the coolant 1 in the liquid level regulating chamber 15 is pushed out into the tank 2. Therefore, the liquid level of the coolant 1 in the tank 2 increases to a height which does not hinder operation of the pump 6. It is preferable to use inert gas such as nitrogen gas as the compressed gas, but it is also possible to use air.

The coolant 1 the temperature of which rises due to cooling of the heat load 3 and which flows back into the tank 2 is cooled by exchanging heat with the refrigerant in the heat exchanger 7 and adjusted to be at the set temperature.

Because the fourth solenoid valve V4 is in an off state to intercept a flow of gas from the supply gas duct 19 toward the feed pipe 4 in the recovery gas duct 31, the compressed gas is not supplied to the feed pipe 4.

When the operation is completed, the circulating apparatus stops and the coolant 1 filling the feed pipe 4, the heat load 3, and the return pipe 5 is recovered into the tank 2. This recovery is carried out automatically as follows. When an automatic recovery start button provided to the controller 13 is pushed, the third solenoid valve V3 is first turned on to open the vapor phase portion of the tank 2 to the outside and then the first solenoid valve V1 and the second solenoid valve V2 in the liquid level regulating gas duct 20 are turned on to open the liquid level regulating chamber 15 to the outside. As a result, a part of the coolant 1 in the tank 2 flows into the liquid level regulating chamber 15 and the liquid level in the tank 2 lowers as shown in FIG. 2A.

Figure 2:
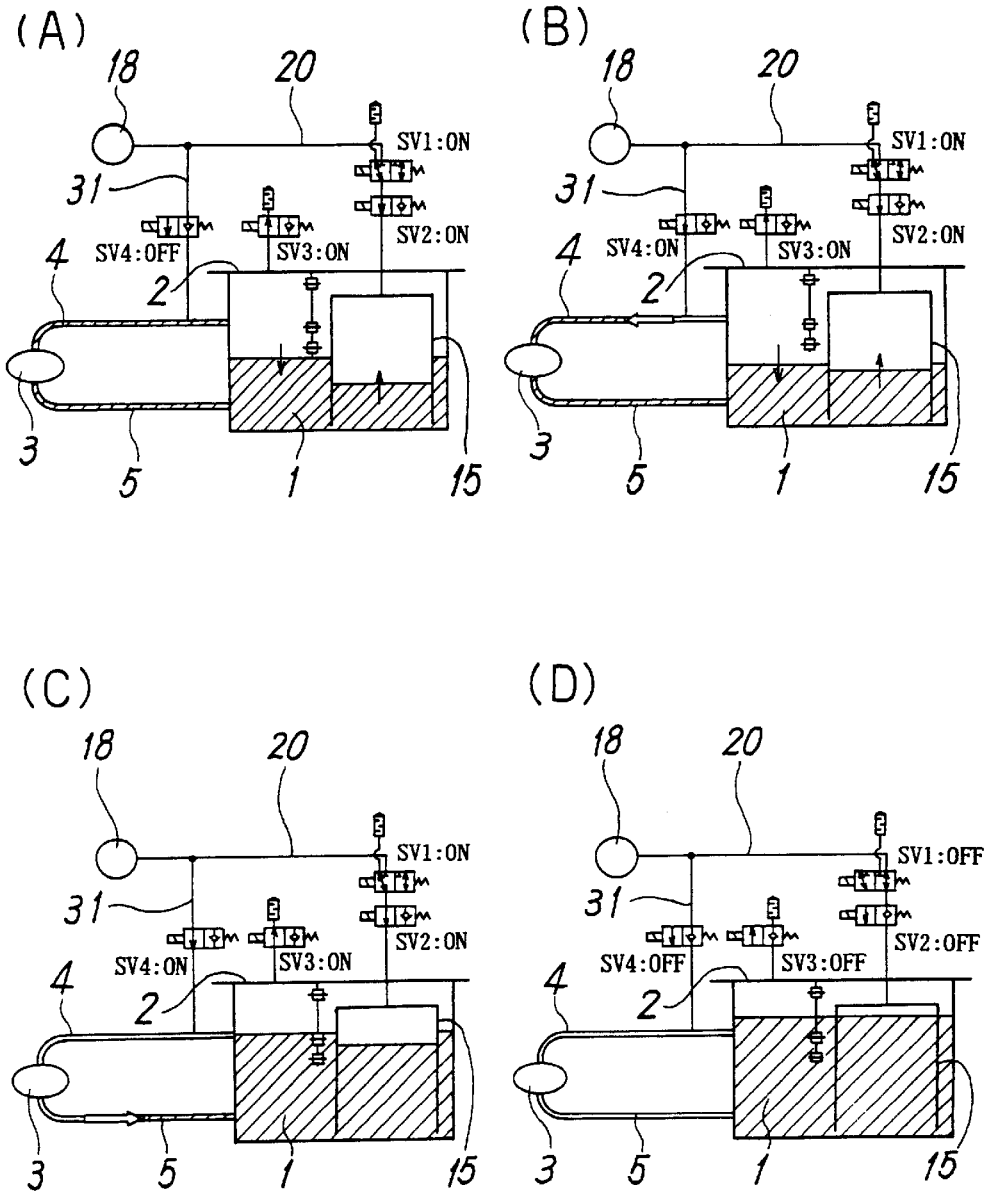
FIGS. 2(A) to 2(D) shows explanatory views for explaining a process of recovery of coolant in order.

Then, as shown in FIG. 2B, the fourth solenoid valve V4 in the recovery gas duct 31 is turned on and the compressed gas from the compressed gas supply source 18 is supplied to the feed pipe 4 through the recovery gas duct 31. As a result, the coolant 1 remaining in the feed pipe 4, the heat load 3, and the return pipe 5 is pressed by the high-pressure gas to flow back into the tank 2 and recovered. Thus, the liquid level in the tank 2 rises and, as a result, the liquid level in the liquid level regulating chamber 15 also rises. The compressed gas supplied into the feed pipe 4 is prevented from directly flowing backward into the tank 2 from the feed pipe 4 by the check valve 11 provided between the feed pipe 4 and the tank 2.

When recovery of the coolant 1 proceeds through a state shown in FIG. 2C to reach a state shown in FIG. 2D, the flowmeter 12 senses that there is no coolant flowing back through the return pipe 5 or the liquid level sensor 27 senses that the liquid level of the coolant 1 in the liquid level regulating chamber 15 has reached an upper limit and detection signals are sent to the controller 13. The controller 13 is actuated by either of the detection signals, the first solenoid valve V1 and the second solenoid valve V2 are first turned off to separate the liquid level regulating chamber 15 from the compressed gas supply source 18, and the third solenoid valve V3 is turned off to separate the vapor phase portion of the tank 2 from outside air to thereby complete the recovery operation. At this time, the fourth solenoid valve V4 in the recovery gas duct 31 may also be turned off simultaneously.

A state after recovery of the coolant is completed shown in FIG. 2D is different from an operating state in FIG. 1 in that the coolant 1 at the same level as that in the tank 2 is housed in the liquid level regulating chamber 15. In other words, the recovered coolant 1 is substantially housed in the liquid level regulating chamber 15. The compressed gas is encapsulated in the feed pipe 4, the heat load 3, and the return pipe 5.

If pressure in the tank 2 abnormally increases due to some circumstances, the check valve 37 for safety opens to release the pressure.

Figure 3:
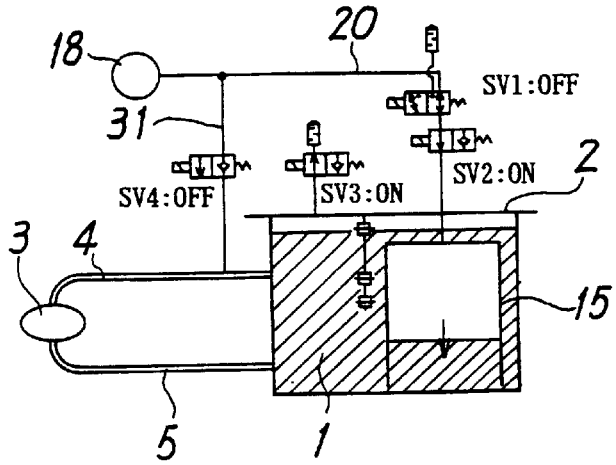
FIGS. 3(A) to 3(C) shows explanatory views for explaining a process of supply of the coolant in order.
Figure 3:
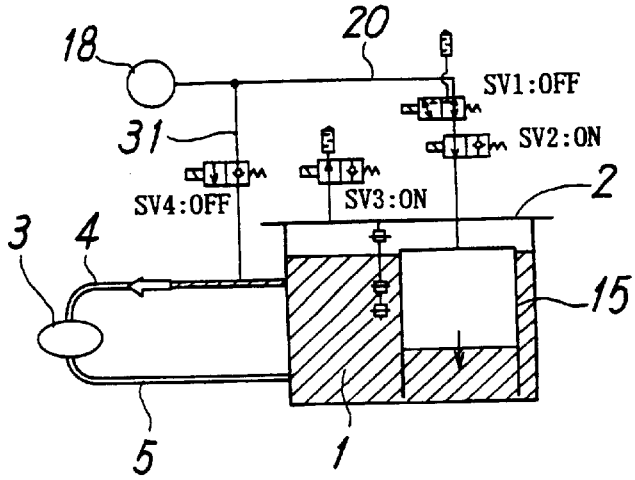
Figure 3:
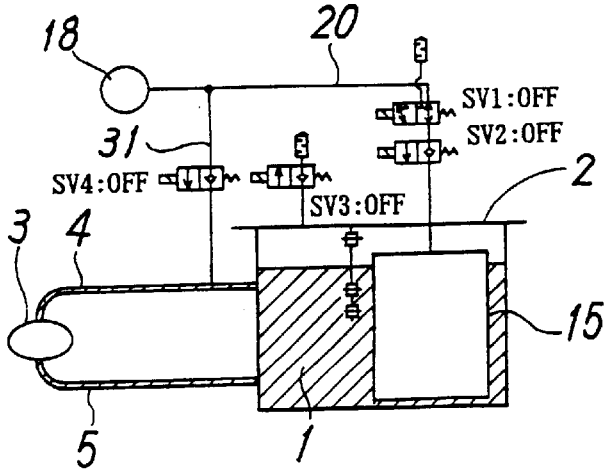

In order to start operation of the circulating apparatus again from the state shown in FIG. 2D in which the recovery has been completed, the coolant 1 is automatically supplied to the heat load 3 as follows. After it is verified that a state of the apparatus before starting operation is normal, the second solenoid valve V2 in the liquid level regulating gas duct 20 and the third solenoid valve V3 connected to the vapor phase portion of the tank 2 are turned on and the compressed gas is supplied into the liquid level regulating chamber 15 from the liquid level regulating gas duct 20 as shown in FIG. 3A. Therefore, the coolant 1 in the liquid level regulating chamber 15 is gradually pushed out into the tank 2 and the liquid level of the tank 2 rises by an amount corresponding to the pushed-out coolant 1. Then, the pump 6 starts operating and the coolant 1 in the tank 2 starts to be supplied to the heat load 3 through the feed pipe 4 as shown in FIG. 3B. At this time, because the coolant is supplied to the heat load 3 and the coolant is pushed out from the liquid level regulating chamber 15 into the tank 2 simultaneously, the liquid level of the coolant 1 in the tank 2 does not lower basically. However, if a supplied amount and a pushed-out amount are not completely the same, the liquid level varies according to a difference between the amounts.

When the coolant completely fills the heat load 3 and the return pipe 5 from the feed pipe 4 and the liquid level sensor 27 senses that the liquid level of the coolant 1 in the liquid level regulating chamber 15 has lowered to a lower limit position, the second solenoid valve V2 in the liquid level regulating gas duct 20 is turned off and the third solenoid valve V3 is turned off. As a result, a supply step is completed and the circulating apparatus is brought into a normal operating state as shown in FIG. 3C. Therefore, the state in FIG. 3C is substantially the same as that in FIG. 1.

If the coolant remaining in the heat load and piping is recovered into another vessel in maintenance and inspection after recovery of the coolant and the coolant 1 in the tank 2 reduces, the coolant may be supplied properly to make up a shortfall when the operation is started again.

If the coolant 1 flows into the liquid level regulating chamber 15 for some reason when the circulating apparatus is in the normal operating state, the liquid level sensor 27 is actuated to send a signal to the controller 13, the third solenoid valve V3 and the second solenoid valve V2 are turned on successively, and the compressed gas is supplied into the liquid level regulating chamber 15 to thereby discharge the coolant 1 in the liquid level regulating chamber 15 into the tank 2. When this discharge is completed, the second solenoid valve V2 and the third solenoid valve V3 are turned off.

Thus, it is possible to efficiently cool the heat load 3 by housing a small amount of coolant 1 in the tank 2 having the liquid level regulating chamber 15 and absorbing and regulating changes in the liquid level in starting of operation and recovery by using the liquid level regulating chamber 15.

Recovery of the coolant 1 can be carried out by supplying the compressed gas to the feed pipe 4 through the recovery gas duct 31 and pressing the coolant 1 building up in the feed pipe 4, the heat load 3, and the return pipe 5 into the tank 2 with the compressed gas. At this time, by automatically and synchronously carrying out recovery of the coolant 1 and regulation of the liquid level in the tank 2 by controlling by opening and closing the respective solenoid valves V1, V2, and V4 connected to the liquid level regulating gas duct 20 and the recovery gas duct 31 with the controller 13, it is possible to easily, efficiently, and automatically recover the coolant 1 in the heat load 3 and piping.

Although the solenoid valve having the check function of stopping only a flow in one direction and allowing a flow in a reverse direction in an off switching state is used as each of the second to fourth solenoid valves V2, V3, and V4 in the above embodiment, it is also possible to use a normal solenoid valve for stopping flows in both going and returning directions in an off switchingstate instead of the above solenoid valve.

Although the completion of recovery of the coolant 1 is sensed from presence or absence of the coolant flowing back in the return pipe 5 or from a change in the liquid level in the liquid level regulating chamber 15, it is also possible to sense the completion of recovery from passage of a set time by setting in the controller 13 the time required for recovery and obtained from a relationship between an amount of coolant in the feed pipe 4, the heat load 3, and the return pipe 5 and a recovering speed.

Although the liquid level regulating chamber 15 is provided in the tank 2 in the embodiment, the liquid level regulating chamber 15 may be provided outside the tank 2 and communicate with the tank 2 through bottom portions.

As described above in detail, according to the invention, it is possible to obtain an economical and rational coolant circulating apparatus with the automatically recovering mechanism, the apparatus being able to be handled easily. In the apparatus, the heat load can be cooled efficiently by using the small amount of coolant, the coolant in the heat load and outside piping can be automatically recovered easily and efficiently and the liquid level in the tank does not change substantially in circulation of the coolant to the heat load and recovery of the coolant from the heat load.

What is claimed is:

1. A coolant circulating apparatus with an automatically recovering mechanism, said apparatus comprising:

a hermetically sealed tank in which a coolant at a controlled temperature is housed;

a heat load connected to said tank through a feed pipe and a return pipe;

a pump for supplying said coolant in said tank to said heat load through said feed pipe and said return pipe in a circulating manner;

a liquid level regulating chamber communicating through a bottom portion thereof with an inside of said tank;

a compressed gas supply source for supplying compressed gas;

a liquid level regulating gas duct including a duct connecting said compressed gas supply source and said liquid level regulating chamber and a solenoid valve connected in said duct to regulate a liquid level of said coolant in said tank by causing said coolant to flow out into said tank from said liquid level regulating chamber or to flow into said liquid level regulating chamber from said tank by switching said solenoid valve to supply or discharge said compressed gas to and from said liquid level regulating chamber;

a recovery gas duct including a duct connecting said compressed gas supply source and said feed pipe and a solenoid valve connected in said duct to cause said coolant building up in said feed pipe, said heat load, and said return pipe to flow back into said tank by switching said solenoid valve to supply said compressed gas to said feed pipe;

a solenoid valve connected to a vapor phase portion of said tank to open said vapor phase portion to an outside in regulation of said liquid level of said coolant;

a level switch provided in said tank to detect said liquid level of said coolant;

a flowmeter connected to said return pipe to detect a flow rate of said coolant flowing in said return pipe; and a controller for controlling said pump and said respective solenoid valves.

2. A coolant circulating apparatus according to claim 1, wherein said liquid level regulating chamber is disposed in said tank to occupy a part of a space in which said coolant is housed.

3. A coolant circulating apparatus according to claim 1, wherein a volumetric capacity of said liquid level regulating chamber is such a size that said coolant in said feed pipe, said heat load, and said return pipe can be housed in said liquid level regulating chamber.

4. A coolant circulating apparatus according to claim 2, wherein a volumetric capacity of said liquid level regulating chamber is such a size that said coolant in said feed pipe, said heat load, and said return pipe can be housed in said liquid level regulating chamber.

* * * * *